US010161634B2

(12) United States Patent
Toon

(10) Patent No.: US 10,161,634 B2
(45) **Date of Patent: *Dec. 25, 2018**

(54) AIRBLAST FUEL INJECTOR

(71) Applicant: ROLLS-ROYCE PLC, London (GB)

(72) Inventor: Ian James Toon, Leicester (GB)

(73) Assignee: ROLLS-ROYCE plc, London (GB)

( * ) Notice: Subject to any disclaimer, the term of this patent is extended or adjusted under 35 U.S.C. 154(b) by 379 days.

This patent is subject to a terminal disclaimer.

(21) Appl. No.: 15/071,786

(22) Filed: Mar. 16, 2016

(65) Prior Publication Data

US 2016/0195274 A1 Jul. 7, 2016

Related U.S. Application Data

(63) Continuation of application No. 14/456,353, filed on Aug. 11, 2014, now Pat. No. 9,310,080.

(30) Foreign Application Priority Data

Aug. 22, 2013 (GB) ..... 1315008.1

(51) Int. Cl.
*F02C 1/00* (2006.01)
*F23R 3/28* (2006.01)
(Continued)

(52) U.S. Cl.
CPC ..... *F23R 3/286* (2013.01); *F23D 11/105* (2013.01); *F23R 3/14* (2013.01); *F23R 3/28* (2013.01);
(Continued)

(58) Field of Classification Search
CPC ..... F23R 3/14; F23R 3/10; F23R 3/12; F23R 3/286; F23C 7/002; F23C 7/004
See application file for complete search history.

(56) References Cited

U.S. PATENT DOCUMENTS 5,737,921 A 4/1998 Jones et al.
2003/0196440 A1 10/2003 Steinthorsson et al.
(Continued)

FOREIGN PATENT DOCUMENTS

EP 1 391 652 A2 2/2004
GB 2456147 A 7/2009
(Continued)

OTHER PUBLICATIONS

Jan. 14, 2015 Search Report issued in European Patent Application No. 14180470.
(Continued)

*Primary Examiner* — Gerald L Sung
(74) *Attorney, Agent, or Firm* — Oliff PLC

(57) ABSTRACT

An airblast fuel injector for a gas turbine engine fuel spray nozzle has, in order from radially inner to outer, a coaxial arrangement of an inner air swirler passage, an annular fuel passage, an annular outer air swirler passage, and an annular shroud air swirler passage. The injector further has an annular shroud having an inner surface profile. Relative to the overall axial direction of flow through the injector the shroud inner surface profile has a convergent section followed by a divergent section, the transition of which forming a first inwardly directed annular nose. The injector further has an annular wall having an outer surface profile, and having an inner surface profile. Relative to the overall axial direction of flow through the injector the wall outer surface profile has a convergent section followed by an outwardly turning section which faces across the shroud air passage to the first nose.

12 Claims, 3 Drawing Sheets

(51) Int. Cl.

| | |
|---|---|
| ***F23R 3/14*** | (2006.01) |
| ***F23R 3/34*** | (2006.01) |
| ***F23D 11/10*** | (2006.01) |

(52) U.S. Cl.
CPC .... *F23R 3/343* (2013.01); *F23D 2900/00015* (2013.01); *F23D 2900/11101* (2013.01)

(56) References Cited

U.S. PATENT DOCUMENTS

| | | | |
|---|---|---|---|
| 2007/0028619 | A1 | 2/2007 | Spooner |
| 2007/0137207 | A1 | 6/2007 | Mancini et al. |
| 2007/0289306 | A1 | 12/2007 | Suria et al. |
| 2009/0173076 | A1 | 7/2009 | Toon |
| 2010/0050644 | A1 | 3/2010 | Pidcock et al. |
| 2010/0269506 | A1 | 10/2010 | Nonaka et al. |
| 2010/0308135 | A1 | 12/2010 | Yamamoto et al. |
| 2012/0305673 | A1 | 12/2012 | Matsuyama et al. |

FOREIGN PATENT DOCUMENTS

| | | | |
|---|---|---|---|
| GB | 2488216 | A | 8/2012 |
| WO | 2011/104304 | A2 | 9/2011 |

OTHER PUBLICATIONS

Feb. 9, 2014 Search Report issued in British Application No. 1315008.1.

AIRBLAST FUEL INJECTOR

This is a Continuation of application Ser. No. 14/456,353 filed Aug. 11, 2014, which claims priority to British Application No. 1315008.1 filed Aug. 22, 2013. The disclosures of the prior applications are hereby incorporated by reference herein in their entireties.

FIELD OF THE INVENTION

The present invention relates to an airblast fuel injector for combustors of gas turbine engines.

BACKGROUND OF THE INVENTION

Fuel injection systems deliver fuel to the combustion chamber of a gas turbine engine, where the fuel is mixed with air before combustion. One form of fuel injection system well-known in the art utilises fuel spray nozzles. These atomise the fuel to ensure its rapid evaporation and burning when mixed with air.

An airblast atomiser nozzle is a type of fuel spray nozzle in which fuel delivered to the combustion chamber by a fuel injector is aerated by air swirlers to ensure rapid mixing of fuel and air, and to create a finely atomised fuel spray. The swirlers impart a swirling motion to the air passing therethrough, so as to create a high level of shear and hence acceleration of the low velocity fuel film.

Typically, an airblast atomiser nozzle will have a number of coaxial air swirler passages. An annular fuel passage between a pair of air swirler passages feeds fuel onto a prefilming lip, whereby a sheet of fuel develops on the prefilming lip. The sheet breaks down into ligaments which are then broken up into droplets within the shear layers of the surrounding highly swirling air to form the fuel spray stream that enters the combustor.

A conventional airblast fuel injector for a fuel spray nozzle has, in order from radially inner to outer, a coaxial arrangement of an inner air swirler passage, an annular fuel passage, an annular outer air swirler passage, and an annular shroud air swirler passage. Mixing of air flow from all three air swirler passages is desirable to minimise smoke and emissions. The outer and shroud air passages have convergent portions which direct their swirling air flows radially inwards, creating shear layers between the air flows and promoting turbulent mixing.

The convergent portion of the outer air passage and the convergent portion of the shroud air passage are typically divided by an annular wall. If the shroud air flow separates from the wall, combustion can occur in this region, producing high metal temperatures which can result in metal loss and consequent deterioration of component performance.

Accordingly, it is desirable to provide a fuel injector that is less susceptible to high metal temperatures.

SUMMARY OF THE INVENTION

A first aspect of the invention provides an airblast fuel injector for a fuel spray nozzle of a gas turbine engine, the injector having, in order from radially inner to outer, a coaxial arrangement of an inner air swirler passage, an annular fuel passage, an annular outer air swirler passage, and an annular shroud air swirler passage, fuel exiting the fuel passage being atomised into a spray by surrounding swirling air exiting the inner, outer and shroud air passages, wherein:

the injector has an annular shroud having an inner surface profile which defines a radially outer side of the shroud air passage, relative to the overall axial direction of flow through the injector the shroud inner surface profile having a convergent section corresponding to a convergent portion of the shroud air passage, the convergent section of the shroud inner surface profile being followed by a divergent section of the shroud inner surface profile, the transition from the convergent section to the divergent section of the shroud inner surface profile forming a first inwardly directed annular nose; and the injector further has an annular wall having an outer surface profile which defines a radially inner side of the shroud air passage, and having an inner surface profile which defines a radially outer side of the outer passage, relative to the overall axial direction of flow through the injector the wall outer surface profile having a convergent section corresponding to the convergent portion of the shroud air passage, the convergent section of the wall outer surface profile being followed by an outwardly turning section which faces across the shroud air passage to the first nose.

Advantageously, by following the convergent section of the wall outer surface profile with an outwardly turning section which faces across the shroud air passage to the first nose, shroud air flow separation from the annular wall can be reduced or prevented, thereby decreasing the likelihood of combustion in this region and high metal temperatures on the annular wall.

A second aspect of the invention provides a fuel spray nozzle having an airblast fuel injector of the first aspect. The airblast fuel injector may be a pilot fuel injector, and the nozzle may further have one or more annular mains fuel injectors radially outwardly of the pilot fuel injector.

A third aspect of the invention provides a combustor of a gas turbine engine having a plurality of fuel spray nozzles of the second aspect.

A fourth aspect of the invention provides a gas turbine engine having a combustor of the third aspect.

Optional features of the invention will now be set out. These are applicable singly or in any combination with any aspect of the invention.

On longitudinal cross-sections through the injector the outwardly turning section may maintain a substantially constant width for the shroud air passage as it turns around the first nose. The constant width can helps to provide an unimpeded air flow through the shroud air passage, which can also decrease the likelihood of combustion in this region.

Relative to the overall axial direction of flow through the injector the wall inner surface profile may have a convergent section corresponding to a convergent portion of the outer passage, the convergent section of the wall inner surface profile being followed by a divergent section of the wall inner surface profile, the transition from the convergent section to the divergent section of the wall inner surface profile forming a second inwardly directed annular nose. In this way, the annular wall can promote an air flow from the outer passage around the second nose which also helps to reduce or prevent air flow separation from the annular wall in the shroud air passage.

The divergent section of the wall inner surface profile and the divergent section of the shroud inner surface profile may have substantially the same conic angle.

The annular wall may be arranged such that a portion of the fuel spray droplets from the atomised fuel impinges on the annular wall forming a fuel film thereon which is re-atomised into a spray by surrounding swirling air. In particular, the annular wall of the present invention typically extends further downstream than the corresponding annular wall of a conventional airblast fuel injector, and can thus be positioned in the pathway of the largest fuel droplets, which have the highest momentums and highest spray angles. When these fuel droplets are re-atomised, the average fuel droplet size can be reduced.

The divergent section of the shroud inner surface profile may extend to a trailing edge of the shroud. Similarly, the outwardly turning section of the wall inner surface profile (and typically also the divergent section of the wall outer surface profile) may extend to a trailing edge of the annular wall. The trailing edge of the annular wall may be axially upstream of the trailing edge of the shroud (for example by a distance which is at least 3% of the diameter of the trailing edge of the shroud). The trailing edge of the annular wall may have a radius of curvature in the range from about 0.125 to 0.250 mm. The trailing edge of the annular wall can be a prefilming lip for fuel spray re-atomisation.

BRIEF DESCRIPTION OF THE DRAWINGS

Embodiments of the invention will now be described by way of example with reference to the accompanying drawings in which.

DETAILED DESCRIPTION AND FURTHER OPTIONAL FEATURES OF THE INVENTION

Figure 1:
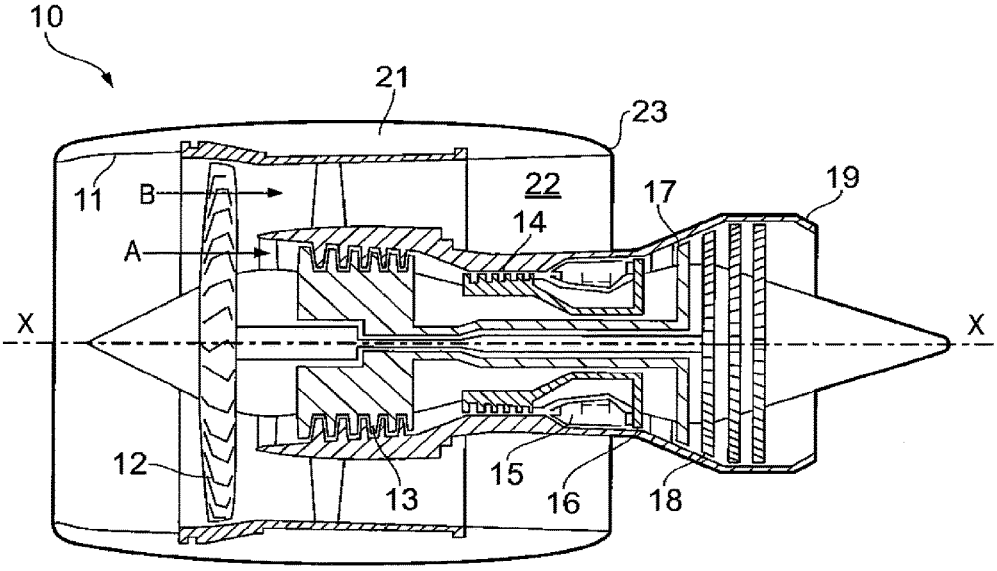
FIG. 1 shows a longitudinal cross-section through a ducted fan gas turbine engine.

With reference to FIG. 1, a ducted fan gas turbine engine incorporating the invention is generally indicated at 10 and has a principal and rotational axis X-X. The gas turbine engine comprises, in axial flow series, an air intake 11, a propulsive fan 12, an intermediate pressure compressor 13, a high-pressure compressor 14, combustion equipment 15, a high-pressure turbine 16, an intermediate pressure turbine 17, a low-pressure turbine 18 and a core engine exhaust nozzle 19. A nacelle 21 generally surrounds the engine 10 and defines the intake 11, a bypass duct 22 and a bypass exhaust nozzle 23.

During operation, air entering the intake 11 is accelerated by the fan 12 to produce two air flows: a first air flow A into the intermediate pressure compressor 13 and a second air flow B which passes through the bypass duct 22 to provide propulsive thrust. The intermediate pressure compressor 13 compresses the air flow A directed into it before delivering that air to the high pressure compressor 14 where further compression takes place.

The compressed air exhausted from the high-pressure compressor 14 is directed into the combustion equipment 15 where it is mixed with fuel and the mixture combusted. The resultant hot combustion products then expand through, and thereby drive the high, intermediate and low-pressure turbines 16, 17, 18 before being exhausted through the nozzle 19 to provide additional propulsive thrust. The high, intermediate and low-pressure turbines respectively drive the high and intermediate pressure compressors 14, 13 and the fan 12 by suitable interconnecting shafts.

Figure 2:
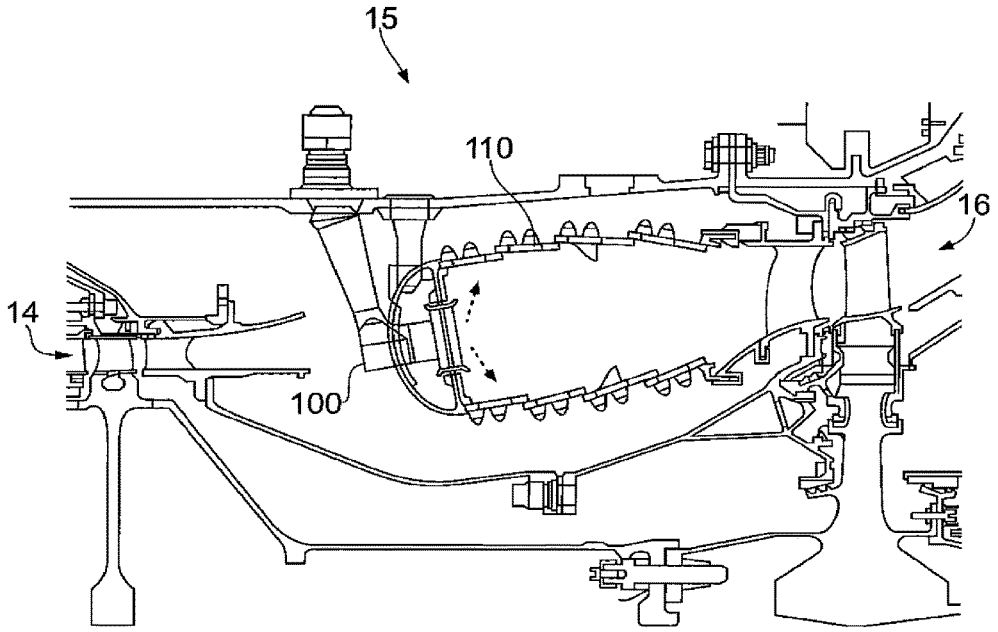
FIG. 2 shows a longitudinal cross-section through combustion equipment of the gas turbine engine of FIG. 1.
Figure 3:
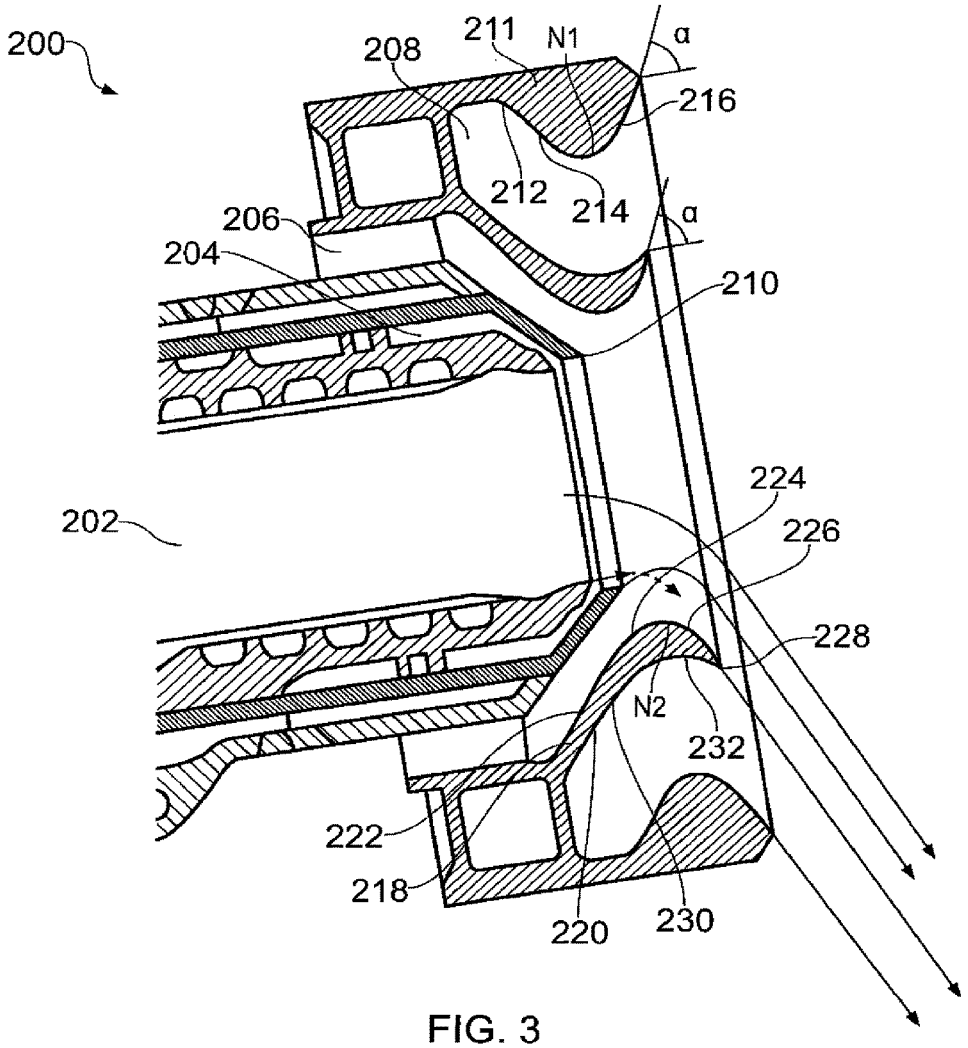
FIG. 3 shows a longitudinal cross-section of an airblast fuel injector for use in the combustion equipment of FIG. 2.

FIG. 2 shows a longitudinal cross-section through the combustion equipment 15 of the gas turbine engine 10 of FIG. 1. A row of fuel spray nozzles 100 spray the fuel into an annular combustor 110. Each of the fuel spray nozzles 100 comprises an airblast fuel injector 200 as shown in FIG. 3. For example, the airblast fuel injector 200 may be a pilot injector of the fuel spray nozzle, which also has one or more annular mains fuel injectors radially outwardly of the pilot injector.

The airblast fuel injector 200 has, in order from radially inner to outer, a coaxial arrangement of an inner air swirler passage 202, an annular fuel passage 204, an annular outer air swirler passage 206, and an annular shroud air swirler passage 208. The fuel passage 204 feeds fuel to a prefilming lip 210. Swirling air flow entrains the fuel on the prefilming lip 210 into a fuel spray (indicated generally by the thick, dotted, arrowed line in FIG. 3), the fuel being atomised into a spray by the surrounding swirling air flows (indicated generally by the thick, solid, arrowed lines in FIG. 3) exiting the inner, outer and shroud air passages 202, 206 and 208 respectively. Mixing of air flows from all three air swirler passages 202, 206 and 208 is desirable to minimise smoke and emissions. With distance from the prefilming lip 210, the fuel spray expands outwardly in a cone of well-atomised fuel droplets.

The airblast fuel injector 200 has an annular shroud 211, an inner surface profile 212 of which defines a radially outer side of the shroud air passage 208. Relative to the overall axial direction of flow through the airblast fuel injector 200, the shroud inner surface profile 212 has a convergent section 214 corresponding to a convergent portion of the shroud air swirler passage 208. The convergent section 214 of the shroud inner surface profile 212 is followed by a divergent section 216, and the transition from the convergent section 214 to the divergent section 216 of the shroud inner surface profile 212 forms a first inwardly directed annular nose N1. This first inwardly directed annular nose N1 directs the shroud air flow radially inwards, creating shear layers between the air flows and promoting turbulent mixing.

The airblast fuel injector 200 further has an annular wall 218 having an outer surface profile 220 which defines a radially inner side of the shroud air passage 208, and having an inner surface profile 222 which defines a radially outer side of the outer passage 206.

Relative to the overall axial direction of flow through the airblast fuel injector 200, the wall outer surface profile 220 has a convergent section 230 corresponding to the convergent section 214 of the shroud air passage 208, followed by an outwardly turning section 232 which faces across the shroud air swirler passage 208 to the first nose N1. The outwardly turning section 232 reduces or prevents flow separation in the shroud air swirler passage 208 from the wall outer surface profile 220. In this way, combustion can be prevented from occurring in this region, allowing metal temperatures of the annular wall 218 to be kept within acceptable limits.

The outwardly turning section 232 of the wall outer surface profile 220 may also be shaped so that, on longitudinal cross-sections through the airblast fuel injector 200, the shroud air swirler passage 208 maintains a substantially constant width as it turns around the nose N1. Advantageously, the constant width helps to prevent restriction of the air flow through the shroud air swirler passage 208, which might otherwise cause early combustion and undesirably high metal temperatures.

The wall inner surface profile 222 also has a convergent section 224 corresponding to a convergent portion of the outer air swirler passage 206. The convergent section 224 of the wall inner surface profile 222 is followed by a divergent section 226, and the transition from the convergent section 224 to the divergent section 226 of the wall forms a second inwardly directed annular nose N2. The divergent section 226 of the wall inner surface profile 222 and the divergent section 216 of the shroud inner surface profile 212 may have substantially the same conic angle α. The radius of curvature of the nose N2 is preferably the largest possible compatible with providing the same conic angle α, and with retaining a length and width of the convergent portion of the outer air swirler passage 206 similar to those found in a conventional airblast fuel injector.

Depending on the aerodynamics of the flow, the radially innermost point of the second nose N2 may be axially upstream or downstream of, or at the same axial position as, the radially innermost point of the first nose N1.

The divergent section 216 of the shroud inner surface profile 212 extends to a trailing edge of the shroud 211. The annular wall 218 extends to a trailing edge in the form of a lip 228 where the divergent section 226 of the wall inner surface profile 222 and the outwardly turning section 232 of the wall outer surface profile 220 meet. The lip 228 can be downstream of, or at the same axial position as, the trailing edge of the shroud 211, but preferably is upstream of the trailing edge of the shroud 211 to help protect the lip 228 from handling damage. For example, the lip 228 may be upstream of the trailing edge of the shroud 211 by a distance which is at least 3% of the diameter of the trailing edge. The lip 228 typically has a radius of curvature in the range from about 0.125 to 0.250 mm.

In general, the largest fuel droplets in the spray issuing from the prefilming lip 210 have the highest momentum and also have the largest spray angle. The annular wall 218 can be configured so that these large droplets impinge onto it, where they can create another fuel film at its own lip 228. The fuel film is shed from the lip 228 as smaller droplets that quickly mix into the air flows. Thus the lip 228 acts as a secondary prefilming lip for airspray atomisation. The impingement of large fuel droplets onto the annular wall and the subsequent atomisation into smaller droplets from the secondary prefilming lip can improve the mixing rate and uniformity of the fuel and air, and hence reduce smoke and improve emissions.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

The invention claimed is:

1. An airblast fuel injector for a fuel spray nozzle of a gas turbine engine, the airblast fuel injector having, in order from radially inner to outer, a coaxial arrangement comprising:

an inner air swirler passage;

an annular fuel passage;

an annular outer air swirler passage, and an annular shroud air swirler passage;

wherein the airblast fuel injector is configured to atomize fuel exiting the annular fuel passage into a spray by way of surrounding swirling air exiting the inner, outer and shroud air passages:

the airblast fuel injector further comprising:

an annular shroud having an inner surface profile, which defines a radially outer side of the annular shroud air swirler passage relative to an overall axial direction of flow through the airblast fuel injector, the annular shroud inner surface profile having a convergent section defining a convergent portion of the annular shroud air swirler passage, the convergent section of the annular shroud inner surface profile being followed by a divergent section of the annular shroud inner surface profile, a transition from the convergent section of the annular shroud inner surface profile to the divergent section of the annular shroud inner surface profile forming a first inwardly directed annular nose, and an annular wall having an outer surface profile and an inner surface profile, the annular wall outer surface profile defining a radially inner side of the annular shroud air swirler passage relative to the overall axial direction of flow through the airblast fuel injector, the annular wall inner surface profile defining a radially outer side of the annular outer air swirler passage relative to the overall axial direction of flow through the airblast fuel injector, the annular wall outer surface profile having a convergent section defining the convergent portion of the annular shroud air swirler passage, the convergent section of the annular wall outer surface profile being followed by an outwardly turning section which faces across the annular shroud air swirler passage to the first inwardly directed annular nose;

wherein:

on longitudinal cross-sections through the airblast fuel injector the outwardly turning section maintains a substantially constant width for the annular shroud air swirler passage as the annular shroud air swirler passage turns around the first inwardly directed annular nose;

relative to the overall axial direction of flow through the airblast fuel injector, the annular wall inner surface profile has a convergent section defining a convergent portion of the annular outer air swirler passage, the convergent section of the annular wall inner surface profile being followed by a divergent section of the annular wall inner surface profile, a transition from the convergent section to the divergent section of the annular wall inner surface profile forming a second inwardly directed annular nose, and a prefiliming lip, wherein the injector is configured so that fuel exiting the annular fuel passage is supplied onto the prefiliming lip to be atomized into the spray by the surrounding swirling air exiting the inner, outer and shroud air passages, the prefilming lip being axially aligned with the convergent section of the annular shroud air swirler passage; and a radially innermost point of the second inwardly directed annular nose is axially downstream of an upstream end of the convergent section of the annular shroud air swirler passage.

2. The airblast fuel injector of claim 1, wherein the radially innermost point of the second inwardly directed annular nose is axially upstream of the radially innermost point of the first inwardly directed annular nose.

3. The airblast fuel injector of claim 1, wherein the radially innermost point of the second inwardly directed annular nose is axially downstream of the radially innermost point of the first inwardly directed annular nose.

4. The airblast fuel injector of claim 1, wherein the radially innermost point of the second inwardly directed annular nose is at a same axial position as the radially innermost point of the first inwardly directed annular nose.

5. A fuel spray nozzle of a gas turbine engine having the airblast fuel injector of claim 1.

6. A fuel spray nozzle according to claim 1, wherein the airblast fuel injector is a pilot fuel injector, the fuel spray nozzle further having one or more annular mains fuel injectors radially outwardly of the pilot fuel injector.

7. An airblast fuel injector for a fuel spray nozzle of a gas turbine engine, the injector having, in order from radially inner to outer, a coaxial arrangement comprising:

an inner air swirler passage;

an annular fuel passage;

an annular outer air swirler passage, and an annular shroud air swirler passage;

wherein the airblast fuel injector is configured to atomize fuel exiting the annular fuel passage into a spray by way of surrounding swirling air exiting the inner, outer and shroud air passages:

the airblast fuel injector further comprising:

an annular shroud having an inner surface profile, which defines a radially outer side of the annular shroud air swirler passage relative to an overall axial direction of flow through the airblast fuel injector, the annular shroud inner surface profile having a convergent section defining a convergent portion of the annular shroud air swirler passage, the convergent section of the annular shroud inner surface profile being followed by a divergent section of the annular shroud inner surface profile, a transition from the convergent section of the annular shroud inner surface profile to the divergent section of the annular shroud inner surface profile forming a first inwardly directed annular nose; and an annular wall having an outer surface profile and an inner surface profile, the annular wall outer surface profile defining a radially inner side of the annular shroud air swirler passage relative to the overall axial direction of flow through the airblast fuel injector, the annular wall inner surface profile defining a radially outer side of the annular outer air swirler passage relative to the overall axial direction of flow through the airblast fuel injector, the annular wall outer surface profile having a convergent section defining the convergent portion of the annular shroud air swirler passage, the convergent section of the annular wall outer surface profile being followed by an outwardly turning section which faces across the annular shroud air swirler passage to the first inwardly directed annular nose;

wherein:

on longitudinal cross-sections through the airblast fuel injector the outwardly turning section maintains a substantially constant width for the annular shroud air swirler passage as the annular shroud air swirler passage turns around the first inwardly directed annular nose;

relative to the overall axial direction of flow through the airblast fuel injector, the annular wall inner surface profile has a convergent section defining a convergent portion of the annular outer air swirler passage, the convergent section of the annular wall inner surface profile being followed by a divergent section of the annular wall inner surface profile, the transition from the convergent section to the divergent section of the annular wall inner surface profile forming a second inwardly directed annular nose, and a trailing end of the annular wall is at a same axial position as a trailing end of the annular shroud air swirler passage.

8. An airblast fuel injector for a fuel spray nozzle of a gas turbine engine, the injector having, in order from radially inner to outer, a coaxial arrangement comprising:

an inner air swirler passage;

an annular fuel passage;

an annular outer air swirler passage, and an annular shroud air swirler passage;

wherein the airblast fuel injector is configured to atomize fuel exiting the annular fuel passage into a spray by way of surrounding swirling air exiting the inner, outer and shroud air passages:

the airblast fuel injector further comprising:

an annular shroud having an inner surface profile, which defines a radially outer side of the annular shroud air swirler passage relative to an overall axial direction of flow through the airblast fuel injector, the annular shroud inner surface profile having a convergent section defining a convergent portion of the annular shroud air swirler passage, the convergent section of the annular shroud inner surface profile being followed by a divergent section of the annular shroud inner surface profile, a transition from the convergent section of the annular shroud inner surface profile to the divergent section of the annular shroud inner surface profile forming a first inwardly directed annular nose; and an annular wall having an outer surface profile and an inner surface profile, the annular wall outer surface profile defining a radially inner side of the annular shroud air swirler passage relative to the overall axial direction of flow through the airblast fuel injector, the annular wall inner surface profile defining a radially outer side of the annular outer air swirler passage relative to the overall axial direction of flow through the airblast fuel injector, the annular wall outer surface profile having a convergent section defining the convergent portion of the annular shroud air swirler passage, the convergent section of the annular wall outer surface profile being followed by an outwardly turning section which faces across the annular shroud air swirler passage to the first inwardly directed annular nose;

wherein:

on longitudinal cross-sections through the airblast fuel injector the outwardly turning section maintains a substantially constant width for the annular shroud air swirler passage as the annular shroud air swirler passage turns around the first inwardly directed annular nose;

relative to the overall axial direction of flow through the airblast fuel injector, the annular wall inner surface profile has a convergent section defining a convergent portion of the annular outer air swirler passage, the convergent section of the annular wall inner surface profile being followed by a divergent section of the annular wall inner surface profile, the transition from the convergent section to the divergent section of the annular wall inner surface profile forming a second inwardly directed annular nose, and a radially innermost point of the second inwardly directed annular nose has a position selected from the group consisting of a position axially downstream of the radially innermost point of the first inwardly directed annular nose and a position at a same axial position as the radially innermost point of the first inwardly directed annular nose.

9. The airblast fuel injector of claim 8, wherein a trailing end of the annular wall is axially upstream of a trailing end of the annular shroud air swirler passage.

10. The airblast fuel injector of claim 8, wherein the airblast fuel injector being configured such that a portion of the fuel spray droplets from the atomized fuel impinges on the annular wall to form a fuel film thereon which is re-atomized into a spray by surrounding swirling air.

11. A fuel spray nozzle of a gas turbine engine having the airblast fuel injector of claim 8.

12. A fuel spray nozzle according to claim 11, wherein the airblast fuel injector is a pilot fuel injector, the fuel spray nozzle further having one or more annular mains fuel injectors radially outwardly of the pilot fuel injector.

* * * * *